US006565051B2

(12) United States Patent
Vaglica

(10) Patent No.: US 6,565,051 B2
(45) Date of Patent: May 20, 2003

(54) PAINT CAN HOLDER

(76) Inventor: Richard Vaglica, 10514 N. Grand Ave., Kansas City, MO (US) 64155

( * ) Notice: Subject to any disclaimer, the term of this patent is extended or adjusted under 35 U.S.C. 154(b) by 0 days.

(21) Appl. No.: 09/777,342

(22) Filed: Feb. 6, 2001

(65) Prior Publication Data

US 2002/0104936 A1 Aug. 8, 2002

(51) Int. Cl.[7] ..... E06C 7/14

(52) U.S. Cl. ..... 248/210; 248/238; 182/107; 182/108

(58) Field of Search ..... 248/146, 210, 248/311.2, 238; 182/129, 107, 214, 108

(56) References Cited

U.S. PATENT DOCUMENTS

| | | | | | |
|---|---|---|---|---|---|
| 1,339,025 | A | | 5/1920 | Garst | |
| 3,584,702 | A | * | 6/1971 | Lang | 182/129 |
| 3,822,846 | A | | 7/1974 | Jesionowski | 248/210 |
| 3,929,208 | A | * | 12/1975 | Hendrich | 182/108 |
| 4,310,134 | A | | 1/1982 | Schopp et al. | 248/210 |
| 4,395,013 | A | | 7/1983 | Wissinger | 248/558 |
| 4,662,594 | A | | 5/1987 | Dubis | 248/238 |
| 4,852,759 | A | * | 8/1989 | Williams et al. | 220/85 H |
| 4,899,848 | A | * | 2/1990 | Parr | 182/108 |
| 5,083,733 | A | | 1/1992 | Marino et al. | 248/110 |
| 5,242,031 | A | * | 9/1993 | Ashley | 182/214 |
| 5,333,823 | A | * | 8/1994 | Joseph | 248/146 |
| 5,533,591 | A | * | 7/1996 | Kiska | 182/108 |
| 5,740,883 | A | * | 4/1998 | Trank | 182/129 |
| 5,826,844 | A | | 10/1998 | Purdy | 248/210 |
| 5,971,103 | A | | 10/1999 | Mulvaney | 182/129 |
| 6,158,551 | A | * | 12/2000 | Gray | 182/214 |

FOREIGN PATENT DOCUMENTS

| | | |
|---|---|---|
| FR | 625 362 | 8/1927 |
| FR | 2 499 145 | 8/1982 |

* cited by examiner

*Primary Examiner*—Anita King
*Assistant Examiner*—Gwendolyn Baxter
(74) *Attorney, Agent, or Firm*—Shook, Hardy & Bacon L.L.P.

(57) ABSTRACT

A container holding apparatus that is removably attachable to the end of a ladder is provided. In the preferred embodiment, the apparatus includes a base structure separating two rail caps. The rail caps have a vertical front surface and an inclined rear surface which are configured to be coupled to the end of the ladder. Between the rail caps is a partially cylindrically shaped sleeve mounted to the base structure for receiving a container. A pair of supports connect the sleeve to a respective rail cap.

10 Claims, 1 Drawing Sheet

PAINT CAN HOLDER

This invention relates to painting accessories and, more particularly, to a holder for a paint can removably attachable to the end of a ladder.

BACKGROUND OF THE INVENTION

Many consider painting to be a laborious and tedious exercise. Virtually everyone has had the opportunity at some time or another to paint the interior or exterior of a house. While painting at ground level can be an unexciting and boring exercise, painting at higher levels from atop a ladder adds a serious element of danger.

Performing any activity atop a ladder at any significant height brings into play the real danger of falling. At many heights at which painting is required, a fall can produce serious injuries, if not death. Therefore, many individuals who paint from a ladder often do so extremely reluctantly and with legitimate fear of bodily harm.

Painting atop a ladder is particularly dangerous for a number of reasons. First, by the very virtue of painting, one's attention is diverted from maintaining safety to performing the painting exercise. This requires that the individual stretch and lean at various angles from the ladder to paint. This stretching and leaning exercise moves the center of gravity of the person to areas not aligned with the ladder. This increases the danger of the individual falling. Second, the user's free hand often is required to maintain the paint source, typically a paint can. In other words, while the user is painting with one hand, their free hand which is ordinarily and preferably intended to hold onto the ladder, must be utilized to hold a rather heavy paint can. This leaves the user with ability to hold onto the ladder. Obviously, this significantly increases the probability of the user falling from the ladder.

There are many devices in the prior art that have been developed in order to address this problem. Most of these devices relate to paint can holders which are attachable to the ladder and which hold the paint can for the user, thereby allowing the user to hold onto the ladder with their free hand. Unfortunately, the paint can holders existing on the market have been either needlessly complex or clumsy to use, thereby reducing the instances of their use or, worse, contributing to falls.

It is therefore an object of the present invention to provide a paint can holder which promotes the safety of the user, thereby reducing the incidence of falls from a ladder.

More particularly, it is an object of the present invention to provide a simple paint can holder which is easy to use and easy to manufacture.

It is also an object of the present invention to provide a paint can holder which is usable in a number of applications and suitable for different painting exercise under a wide range of conditions.

It is further an object of the present invention to provide a paint can holder which is inexpensive to manufacture and sell.

Also, it is an object of the present invention to provide a paint can holder which is relatively inexpensive to purchase, thereby improving the likelihood that it will be purchased and used.

It is a related object of the present invention to provide a paint can holder that can be used on most ladders and in most uses irrespective of the angle of inclination of the ladder.

SUMMARY OF THE INVENTION

To accomplish these and other related objects of the present invention, the present invention relates to a paint can holder removably attachable to the end of a ladder. In the preferred embodiment, the holder includes a base structure separating two rail caps. Between the rail caps is a partially cylindrically shaped sleeve mounted to the base structure. A pair of supports connect the sleeve to a respective rail cap. In operation, the holder is placed on the end of a ladder by inserting the end of each rail of the ladder into a respective rail cap on the holder. The ladder is then placed against the structure to be painted. The user climbs the ladder and places the paint can within the sleeve on the structure. The paint can is held in level position on the end of the ladder. The user is therefore allowed to hold on to the ladder with his or her free hand while still being able to access the source of paint without interrupting or impeding their ability to perform their painting task.

BRIEF DESCRIPTION OF THE DRAWINGS

The preferred embodiment of the present invention is described in detail below with reference to the attached drawings, wherein.

DETAILED DESCRIPTION OF THE PREFERRED EMBODIMENT

Figure 2:
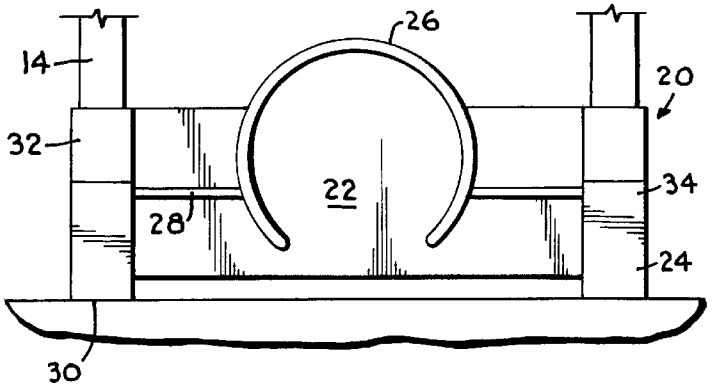
FIG. 2 is a top plan view of the holder apparatus shown in FIG. 1.
Figure 3:
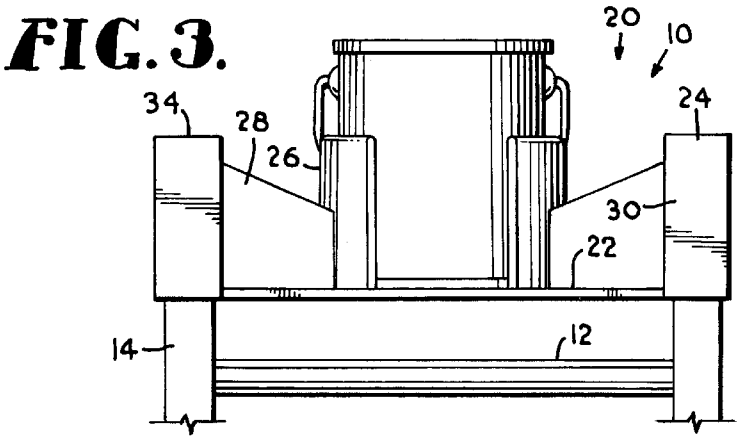
FIG. 3 is a front elevational view of the apparatus.
Figure 1:
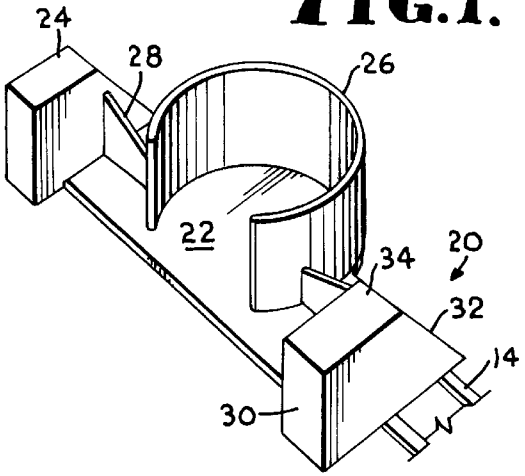
FIG. 1 is a perspective view of a holder apparatus constructed in accordance with preferred embodiment.

A conventional extension ladder 10 typically includes a plurality of laterally spaced rungs 12 mounted between a pair of parallel side rails 14. The side rails 14 typically extend a distance above the top rung 12 and terminate at stub ends 16. These ends 16 are used to support the ladder 10 against a structure of some kind, such as a house 18. The holder apparatus of the present invention is broadly designated by the numeral 20. The holder apparatus 20 includes a base member 22 separating two rail caps 24. Intermediate the rail caps 24 is a sleeve 26 shaped as a partial cylinder. The sleeve 26 is connected to each rail cap 24 by corresponding support members 28.

The base member 22 preferably is a flat plate. It is to be understood that other configurations of the base member 22 may be employed without departing from the scope of the present invention. The base member should be sized and constructed to support at least a gallon-sized paint container. It should be sufficiently rigid to support the weight of at least a full gallon-sized paint container. In the preferred embodiment, the support member is approximately 13 inches wide and approximately 6¼ inches deep. It is to be understood that other dimensions for the support member can be employed without departing from the scope of the present invention.

A rail cap 24 is disposed at each side of the base member 22. Each rail cap is spaced and sized to receive a stub end 16 of a rail 14 of a ladder 10. Typically, the rail caps 24 are spaced apart to receive the ends 16 of a conventional ladder, generally between 13 and 18 inches. Generally, each rail cap has a trapezoidal elevational cross-section featuring a generally vertically disposed forward surface 30 and a rearwardly inclined rear surface 32. A top surface 34 separates the forward surface 30 and the rear surface 32. The top surface is generally horizontally disposed, forming a right angle with respect to the forward surface 30 and an obtuse angle with respect to the rear surface 32.

Figure 4:
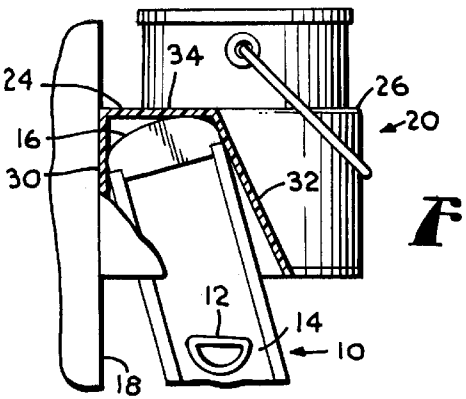
FIG. 4 is a fragmentary sectional view of the holder apparatus shown in FIG. 1, parts being broken away to show the engagement of the end of the ladder rail with the rail cap of the apparatus.

As seen best in FIG. 4 of the attached drawings, the rail cap 24 is disposed to receive the stub end 16 of a rail 14 of a ladder 10. The forward surface 30 of the rail cap is designed to abut the structure against which the ladder 10 is placed. The outward portion of forward surface 30 is smooth, but can be equipped with a scratch resistant or slip resistant composition if circumstances require. Forward surface 30 preferably is vertical and disposed at a right angle with respect to the base member and with respect to top surface 34. This orientation allows the support member 28 to be maintained in horizontal disposition when the holder 20 is placed against a house 18. The respective orientation of the front surface 30 and the support member 28 performs a self-leveling operation to maintain a paint can in a level orientation to enhance its use.

The rear surface 32 has an angle of inclination of approximately 115° with respect to the top surface 34. It is to be understood that other angles of inclination can be employed in connection with the present invention without departing from its scope. The angle of inclination is selected primarily to allow the ladder 10 to be placed at varying degrees of angles with respect to the house 18. As seen in FIG. 4, the apparatus 20 can be utilized in connection with a ladder placed at an angle less than the angle of inclination of the rear surface 32. Irrespective of this angle, the holder 20 is maintained against the side of the house 18 in such a way to level support member 28 which in turn levels the paint can. The angle of inclination of the rear surface 32 allows the bottom of a ladder 10 to be placed at a significant distance away from the house 18. If the bottom of the ladder is placed too far from the house 18, the side rails 18 of the ladder will become improperly mated against the rear surface 32 of the holder 20, thereby indicating to the user that an unsafe ladder angle is being used. In this manner, the angle of inclination of the rear surface 32 provides a safety indicator to the user with respect to the angle of inclination of the ladder 10.

Sleeve 26 generally comprises a partial cylinder having a generally semicircular configuration. In the preferred embodiment, sleeve 26 has an open portion toward the front of the holder 20. This open portion allows for improved insertion or removal of the paint can 36. The size of the sleeve 26 is preferably sufficient to hold a gallon-sized paint can 36. However, other shapes and sizes of sleeve 26 can be employed without departing from the scope of the present invention. In the preferred embodiment, if smaller paint cans are anticipated to be used, a shim of some well-known variety can be placed between the paint can and the sleeve to hold the can in place. In the preferred embodiment, sleeve 26 is approximately 5 inches high and approximately 7 inches in diameter. It is to be understood that other dimensions can be employed without departing from the scope of the present invention.

A pair of support members 28 preferably are used in connection with the holder 20 of the present invention. The support members 28 are shaped as plates and span between a respective rail cap 24 and the sleeve 26. The support members enhance the rigidity of the holder 20 while also maintaining a more secure relationship between the sleeve 28 and the rail caps 24. The shape and size of support members 28 may be selected to achieve specific rigidity or structural stability factors. Accordingly, a wide range of shapes and configurations are within the scope of the present invention.

In the preferred embodiment, holder 20 is manufactured in a one-piece construction utilizing injection molding technology. Holder20 preferably is constructed of a high impact, durable plastic composition. The rail caps 24 are spaced to accommodate a standard extension ladder and are configured to receive a pair of stub ends of conventional shape in the industry. It is to be understood that holder 20 can be manufactured for any specific ladder specifications depending on the circumstances to be used. It is also to be understood that the holder 20 of the present invention can be manufactured by welding, brazing, bolting, gluing or otherwise securing the individual components of the holder 20 together. While this would appear to be less economically attractive, these types of manufacturing processes are within the scope of the present invention.

In use, holder 20 is placed on the end of a ladder 10. Holder 20 is attached to ladder 10 by inserting the stub ends 16 of the rails 14 of the ladder 10 into the rail caps 24 of the holder 20. The stub ends 16 abut the bottom of the top surface 34 of the respective rail caps 24. The ladder 10 is then placed against the house 18 or other structure involved. The angle of inclination of the rear surface 32 allows the ladder 10 to be placed at a varying distance away from the house 18. Once the ladder 10 is placed too far from the house 18, the angle of inclination of rear surface 32 will provide an undesirable mounting orientation for the holder 20, thereby notifying the user that the ladder may be placed at an improper distance away from the structure 18. The forward surface 30 of the rail caps 24 provides a self-leveling function for support member 28. At any angle of inclination of the ladder 10 used, the support member 28 will be maintained in a horizontal disposition. The outer portion of the forward surface 30 typically is constructed to be of a smooth finish. However, it is to be understood that the present invention may include non-slip or scuff-resistant compositions applied to the outer portion of forward surface 30.

Once the ladder 10 is placed against the house 18, the user can ascend the ladder holding in one hand a paint can and using the free hand to support themselves as they ascend the ladder. When the user reaches a point near the top of the ladder 10, the user places the paint can 36 into the sleeve structure 26 of the holder 20. The paint can 36 is maintained in a secure engagement within sleeve 26 and, given the self-leveling operation of holder 20, the paint can 36 is maintained in a level disposition. The user can then access the paint within the can 36 and paint the structure 18 in a safe manner. The user can maintain a grasp on a rail 14 or rung 12 of ladder 10 while the painting exercise is ongoing. The holder 20 need not be manipulated by the user at that time. Instead, the user can use their free hand to ensure that they will not fall from the ladder 10.

As can be seen, there are numerous advantages associated with the holder apparatus 20 of the present invention. Chief among these advantages is the cost-effectiveness and simplicity of the device. The holder apparatus 20 of the present invention is of a one-piece construction. There are no moving parts. In addition, in the preferred embodiment, the holder apparatus 20 is manufactured using relatively inexpensive injection molding procedures. The result will be a very economically priced and simply manufactured device. Similarly, the holder apparatus 20 of the present invention is extremely simple to use. There are no moving parts associated with the holder 20 and there are no assembly requirements associated with its use. Rather, the user merely places the holder 20 on the end of a ladder 10 and then places the ladder against the house or other structure to be painted. The configuration of the rail caps 24 of the holder 20 allow the holder to be used in a variety of applications and under varying inclination angles of the ladder 10. Because most painting applications require that the painting be done at the top of the ladder, the location of the holder apparatus 20 on the end of the ladder 10 is optimum. The weight of the paint can 36 is centered over the vertical center line of the ladder 10, thereby improving the stability of the ladder.

Although the present invention has been described with reference to the preferred embodiment illustrated in the attached drawings, it should be noted that substitution may be made and equivalents employed herein without departing from the scope of the invention as recited in the claims.

What is claimed is:

1. A container holding apparatus for use in connection with a ladder having a pair of laterally spaced rails and stub ends associated with each rail, the apparatus comprising:

a base member having a pair of opposed sides;

a pair of rail caps each having a vertical front surface and an inclined rear surface, the rail caps configured to receive the stub ends of the rails of the ladder and allow the stub ends of the ladder to move freely between the front surface and rear surface; and a sleeve structure disposed on the base member for receiving a container, wherein each rail cap is disposed at each side of the base member so that the base member is positioned between the rail caps.

2. The apparatus of claim 1 wherein the rail cap has a trapezoidal cross-section.

3. The apparatus of claim 1 further comprising a support member disposed between the rail cap and the sleeve structure.

4. The apparatus of claim 3 wherein the apparatus is constructed of plastic.

5. The apparatus of claim 1, wherein each rail cap includes a bottom edge which is substantially planar with the base member.

6. The apparatus of claim 1, wherein the sleeve includes a front portion, wherein the front portion has an open portion defined therein so that the container can be inserted or removed from the sleeve.

7. The apparatus of claim 1, wherein each rail cap includes an inner side wall and an exterior side wall disposed between the front and rear surfaces, wherein the base is coupled with a lower portion of the interior side wall.

8. The apparatus of claim 1, wherein the base member includes a leading edge that is adapted to be adjacent to a wall structure, wherein the front wall of at least one of the rail caps is positioned at a distance beyond the leading edge of the base member.

9. The apparatus of claim 8 wherein the front surface of each of the rail caps is approximately perpendicular with the base member.

10. A container holding apparatus for use in connection with a ladder having a pair of laterally spaced rails and stub ends associated with each rail, the apparatus comprising:

a base member having a pair of opposed sides and a leading edge, the leading edge adapted to be positioned adjacent to a wall structure;

a pair of rail caps each having a vertical front surface, an inclined rear surface, an interior side wall and an exterior side wall, the interior and exterior side walls being disposed between the front and rear surfaces, the opposite sides of the base member being coupled with a lower portion of the interior side walls of the rail caps;

a sleeve structure disposed on the base member for receiving a container, the sleeve structure having a front portion with an open portion defined therein; and a support member extending from each rail cap to the sleeve structure, wherein the rail caps are disposed at the opposed sides of the base member so that the base member is positioned between the rail caps, wherein the rail caps configured to receive the stub ends of the rails of the ladder and allow the stub ends of the ladder to move freely between the front surface and rear surface, wherein the front surface of at least one of the rail caps being positioned at a distance from the leading edge of the base member, and wherein the front surface of each of the rail caps is approximately perpendicular with the base member.

* * * * *